US006159550A

United States Patent [19]

Daluise

[11] Patent Number: 6,159,550

[45] Date of Patent: Dec. 12, 2000

[54] METHOD AND APPARATUS FOR APPLYING RESILIENT ATHLETIC SURFACES

[76] Inventor: Daniel A. Daluise, 11 Skylar Dr., Southboro, Mass. 01772

[21] Appl. No.: 08/390,281

[22] Filed: Feb. 15, 1995

Related U.S. Application Data

[63] Continuation of application No. 08/111,189, Aug. 24, 1993, abandoned, which is a continuation of application No. 07/894,084, Jun. 5, 1992, abandoned.

[51] Int. Cl.[7] ..... B05D 1/34

[52] U.S. Cl. ..... 427/426; 427/136; 427/196; 472/92; 239/416.5; 239/424; 239/425.5; 239/430; 239/549; 239/553.5; 239/558

[58] Field of Search ..... 118/300, 308; 427/426, 196, 197, 136; 472/92, 94; 239/430, 432, 549, 553.5, 558, 590, 416.5, 424, 425.5

[56] References Cited

U.S. PATENT DOCUMENTS

| | | | |
|---|---|---|---|
| 2,025,974 | 12/1935 | Fritz | 91/44 |
| 3,676,198 | 7/1972 | McGroarty | 117/105.5 |
| 4,411,389 | 10/1983 | Harrison | 239/427.5 |
| 4,420,513 | 12/1983 | Coke et al. | 427/407.1 |
| 5,320,870 | 6/1994 | Sorathia et al. | 427/385.5 |

OTHER PUBLICATIONS

Allentown Pneumatic Gun, Inc. brochure: Dry Process: pp. 1–5 (no date).

AIRPLACO brochure; C–7 Rotary Gunite Machine; 2–Pages (no date).

Allentown Pneumatic Gun, Inc. brochure; GRH 600 Rotary Gun; 2–pages (no date).

Allentown Pneumatic Gun, Inc. brochure; Specifications; pp. 1–32 (no date).

Sprintrax Brochure; booklet (no date).

*Primary Examiner*—Shrive Beck
*Assistant Examiner*—Jennifer Calcagni
*Attorney, Agent, or Firm*—Nields & Lemack

[57] ABSTRACT

A method and apparatus for continuously coating particulate such as rubber with liquid binder and applying the same to a substrate to form resilient athletic surfaces. Total encapsulation of the particulate with the liquid binder is accomplished prior to applying the mix to the substrate. In addition, the method of delivery of the particulate and binder maintains the ratios thereof uniform. In its method aspects, the instant invention involves separately introducing a stream of particulate and a stream of binder into a spray nozzle, where they are combined and delivered to the substrate. The apparatus includes a nozzle assembly having a central lumen and an elongated tip, the lumen being formed so as to force the particulate introduced therein to follow a circuitous or indirect path therethrough and thereby decrease its velocity prior to being ejected from the nozzle.

17 Claims, 2 Drawing Sheets

METHOD AND APPARATUS FOR APPLYING RESILIENT ATHLETIC SURFACES

This application is a continuation of application Ser. No. 08/111,189 filed Aug. 24, 1993 (abandoned), which is a Continuation of application Ser. No. 07/894,084 filed Jun. 5, 1992 (Abandoned).

BACKGROUND OF THE INVENTION

The invention pertains to a method and apparatus for applying resilient surfaces to be used for running tracks, tennis courts, playgrounds, jogging paths, ballfield warning tracks and other activity areas requiring resilience.

Many materials and methods of application have been used to produce all-weather surfaces for the aforementioned uses, including pre-manufactured and in situ types. These systems typically involve a mixture of rubber granules, which provide resilience and traction, and a liquid binder, which hardens or cures and thereby holds the rubber particles in a solid matrix.

Pre-manufactured products are expensive and difficult to install. Indeed, the installation of pre-manufactured products inevitably results in many seams or joints which can fail in outdoor use. Accordingly, most installations of all-weather surfaces have been of the in situ (formed on site) type. Currently, there are two basic methods of in situ installation, commonly referred to as "dry" and "wet" applied.

The dry method involves spreading dry rubber particulate by hand or by mechanical means over the area to be surfaced. After the rubber is spread, liquid binder (usually an asphalt emulsion or various latex compounds) is sprayed over the particulate at a specified application rate. This process is repeated in succeeding layers of rubber particulate sprayed with binder until the desired surface thickness is achieved.

The wet application process involves mixing rubber particulate with liquid binder in a mixer at specific ratios and batch sizes. The resulting slurry is spread onto the area to be surfaced by hand or mechanical means. This application is usually done in multiple layers when using latex binder and in one mechanically paved layer when using urethane binders.

The wet and dry methods of application have the disadvantage of being labor intensive and time consuming. In addition, the dry application method has the further disadvantage of being too dependent on the experience of the applicator. In particular, improper application renders surfaces installed by this method prone to inconsistent results which are manifested in weak or easily abraded areas of the surface, whereas experienced applicators are better able to insure complete and total encapsulation of the rubber particulate and thus avoid the above problems.

In view of the added difficulties associated with the dry application method, various attempts have been made to devise continuous wet application methods rather than batch.

One such method involves the mixing of urethane binders with rubber granules (usually at a ratio, by weight, of 60% binder, 40% rubber), pumping the mixture through a hose and spraying it through an orifice onto the substrate. However, this type of application, which is known in the art as a structural spray method, is limited to a particle size of approximately 2 mm, and requires a high ratio of binder. Attempts have been made to use this method with latex binders, however there is a tendency for the rubber to separate from the liquid and clog the hose. Moreover, even with latex binders the particle size is limited to a maximum of 2 mm. With rubber particle sizes larger than 2 mm, the velocity of the rubber exiting the tip of the spray nozzle was such that the rubber "bounced" when impacting the substrate, thereby separating the rubber from the liquid binder. Hence, this method is inappropriate for surfaces with greater than 2 mm in depth because of the man-hours required for application of thicker surfaces. In addition, the rubber and binder are mixed in a hopper, and unless conveyed to the site of application promptly, may set prematurely either in the hopper, the hose, or the spray nozzle.

SUMMARY OF THE INVENTION

The problems of the prior art have been solved by the instant invention, which provides a method and apparatus for coating particulate material such as rubber with liquid binder and batches of rubber and binder. Total encapsulation of the rubber particulate with the liquid binder is accomplished prior to applying the mix to the substrate. In addition, the method of delivery of the rubber and binder maintains the ratios thereof uniform; thus, the system is not prone to mechanical problems such as clogging.

In its method aspects, the instant invention involves separately introducing a stream of particulate and a stream of binder into a spray nozzle, where they are combined and delivered to the substrate.

The apparatus of the instant invention includes a nozzle assembly having a central lumen and an elongated tip, the lumen being formed so as to force the rubber particulate introduced therein to follow a circuitous or indirect path therethrough and thereby decrease its velocity prior to being ejected from the nozzle.

DETAILED DESCRIPTION OF THE INVENTION

One suitable rubber utilized in the instant invention is a terpolymer elastomer made from ethylene-propylene diene monomer (referred to hereinafter as "EPDM"), typically used when colored surfaces are desired. It will be understood by those skilled in the art that any suitable rubber or resilient particulate can be used, depending on the application. For example, other particulate material suitable for use in the present invention includes ground tire rubber (SBR) and resilient plastics. Where multiple layers are applied, each layer need not be comprised of the same particulate material.

The binder system also depends on the application, and can be any liquid system capable of forming a bond with the particulate, such as an asphalt emulsion, urethane system, latex system, or any combination thereof. For example, suitable binders include carboxylated styrene butadiene latex, styrene-acrylic copolymer latex, acrylic latex, vinyl acrylic latex, water-borne urethane (aromatic and aliphatic), diphenylmethane diisocyanate-urethane (MDI), and toluene diisocyanate (TDI). Suitable surfaces which are a combination of particulate and binder are exemplified by those commercially available from Sprintrax under the Sprint 200®EA (a carboxylated styrene butadiene latex based surface), Sprint 200®E, Sprint 200®, Sprint 200® Supreme (an acrylic co-polymer based surface), Sprint 300™ (MDI) and Sprint 400™ (TDI), Sprint 2000 Supreme (water-borne urethane) and Sprintcote series.

The surface to be constructed in accordance with the present invention is typically applied to an existing asphalt or concrete base.

Figure 1:
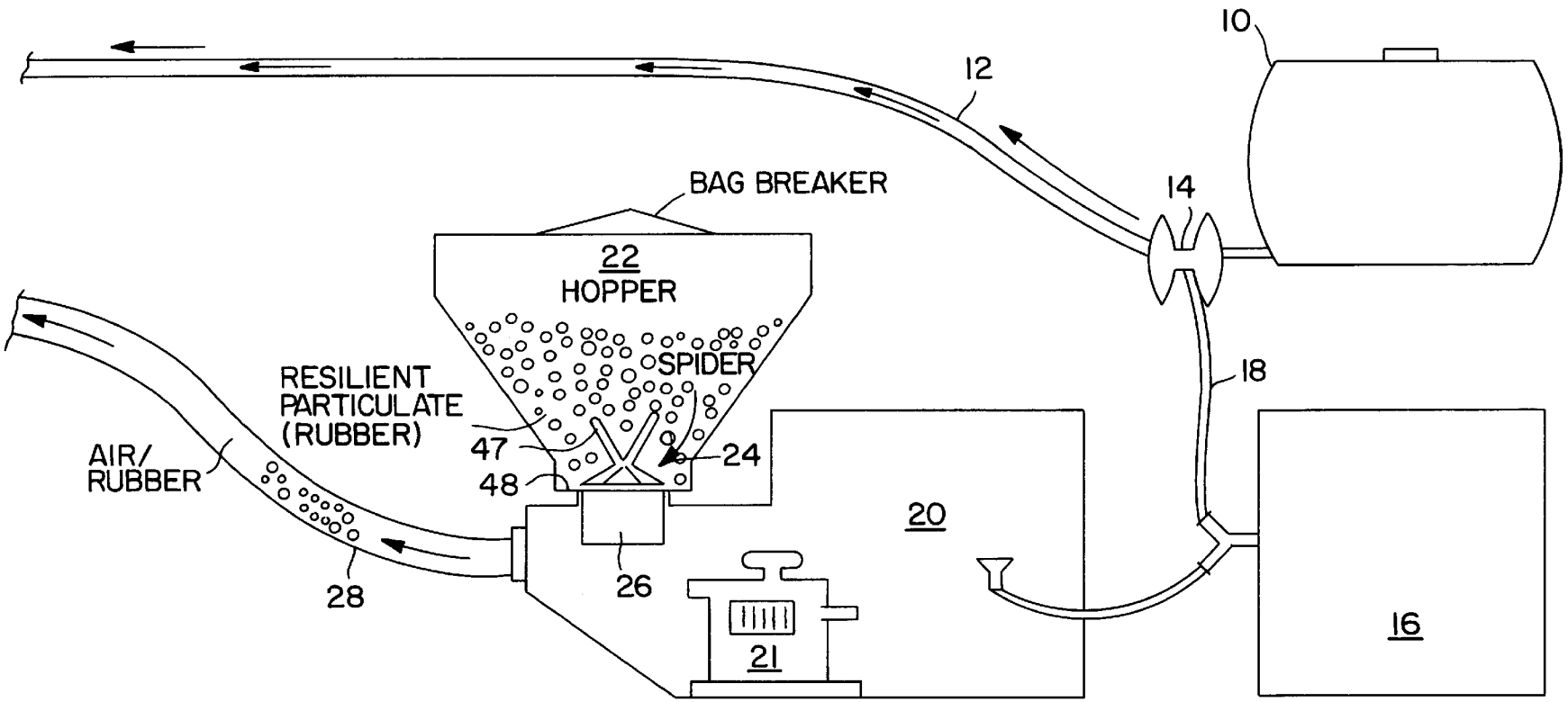
FIG. 1 is a partial diagrammatic view of the apparatus used in accordance with the present invention.

Turning now to FIG. 1, there is shown apparatus to be used in accordance with the instant invention. The apparatus is a modification of conventional equipment typically used for the application of GUNITE, such as the GRH 600 Rotary Gun commercially available from Allentown Pneumatic Gun, Inc.

Figure 2:
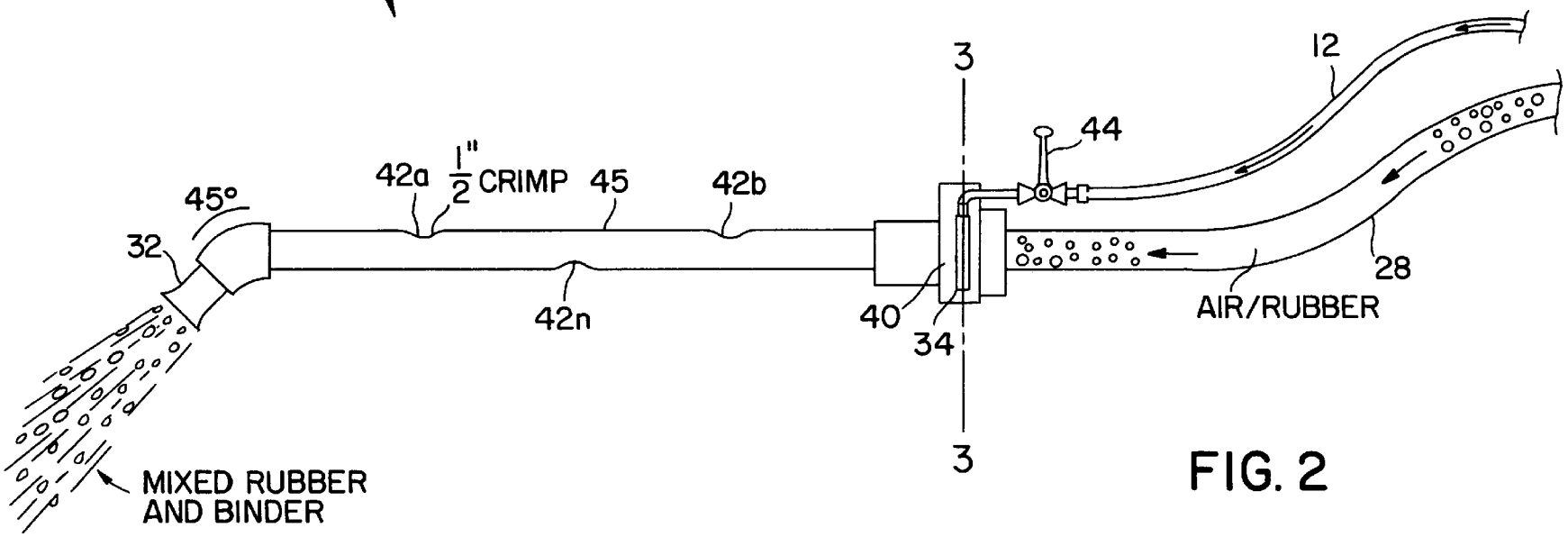
FIG. 2 is a side view of the nozzle assembly used in accordance with the present invention.

Liquid binder is stored in holding tank 10 of suitable size. Suitable liquid binder feed hose, such as ¾" I.D. rubber hose 12 is connected to tank 10 and is in communication with the nozzle 30 (FIG. 2). Pump 14, which can be any suitable type typically available for the purpose of pumping the type of liquid binder being used, such as an air actuated or motor driven pump, is attached to the hose 12 and produces sufficient pressure to convey the liquid binder to the nozzle 30. In the case of an air actuated pump, a compressor 16 of suitable capacity (100 cfm as been found to be appropriate) and an air line 18 associated therewith and with the pump 14 is used.

The compressor 16 also can be used to drive and provide transport air for the rotary gun/hopper assembly 20. The hopper 22 is of suitable capacity to hold sufficient rubber particulate, preferably in excess of 250 pounds of rubber particulate. The hopper 22 preferably includes a bag breaker, as the rubber material is typically packaged in a paper bag. A spider 24 comprising a vertical rod (not shown) with small horizontal or angled arms 47 projecting into the hopper chamber is attached perpendicular to the feed hole 48 and is caused to rotate within the hopper 22 by a rotor 26 driven by motor 29 in the rotary gun. Operation of the spider 24 helps prevent bridging, blocking and/or agglomeration of the rubber in the hopper 22 and breaks up any agglomerations of particulate than may have formed. The spider 24 also helps in continuously feeding the rubber particulate through a rotating manifold or rotor 26 which distributes the particulate evenly into an air stream. The air stream may be produced by any suitable means, such as by a blower or air compressor. Where an air compressor is used, it can be the same compressor used to actuate air pump 14. The particulate is transported by the air stream through a hose 28 to the nozzle 30. A hose having an internal diameter of 1.25 inches has been found to be suitable for transporting the rubber particulate in the air stream to the nozzle 30.

Figure 3:
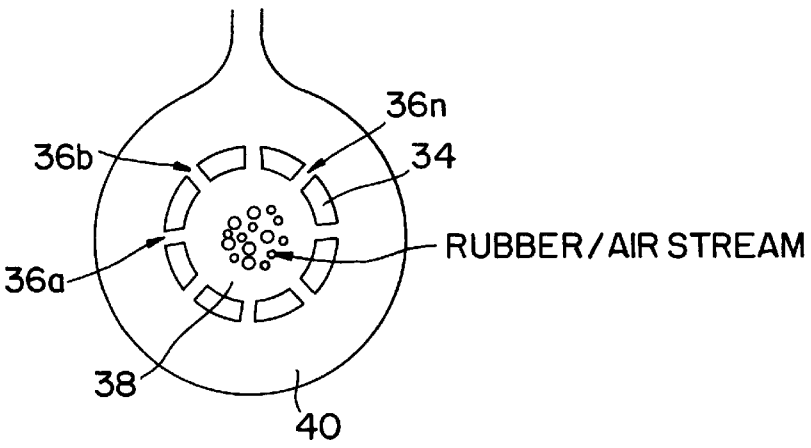
FIG. 3 is a cross-sectional view of the dispersing ring of the nozzle assembly along lines A—A of FIG. 2.

Turning now to FIG. 2, there is shown a nozzle 30 which includes a conduit portion 45 and a nozzle head 32 at a distal end of the conduit portion 45, the head 32 being positioned at about a 45° angle with respect to the conduit portion. A suitable internal diameter of the conduit portion 45 is 1.25 inches. A dispersing ring 34 (best seen in FIG. 3) is located at the proximal end of the nozzle 30. A plurality of circumferential orifices 36*a*–36*n* are formed in the dispersing ring 34, with eight evenly spaced orifices each having a diameter of 9/64" being preferred, although it should be understood by those skilled in the art that the size and number of the orifices depends on the viscosity of the liquid binder being used. The hose 28 is coupled to the proximal end of the nozzle 30, and the air stream conveying the rubber is introduced into the nozzle 30 and flows through the central lumen 38 of the dispersing ring 34. The liquid binder is pumped via feed hose 12 into the circular chamber 40 housing the dispersing ring 34 (FIG. 3). Pressure developed by the pump 14 forces the liquid binder through orifices 36*a*–36*n* in the dispersing ring 34, causing the binder to enter into the air stream carrying the rubber particulate. As the air stream carrying the particulate and binder flows toward the distal end of the nozzle 30, the binder becomes uniformly dispersed in the air stream and ultimately the particulate becomes encapsulated by the binder.

Other means of introducing the binder into the rubber include the use of multiple spray heads (not shown) through which the binder is sprayed into the air stream carrying the rubber.

In order to reduce the velocity of the binder-coated rubber particulate exiting the nozzle head 32, and thereby reduce or prevent the particulate from bouncing when it impacts the substrate, the length of the nozzle 30 between the dispersing ring 34 and the end of the nozzle head 32 should exceed twelve inches. Preferably the length of the nozzle 30 is about 20 to about 32 inches long, most preferably at least about 24 inches long. The elongated nozzle 30 also results in additional contact and wetting of the particulate with the liquid binder, which in turn causes further encapsulation of the rubber particulate by the binder. In addition, in order to create a circuitous or indirect flow path as the air stream travels from the dispersing ring 34 to the nozzle head 32, crimps or pinches 42*a*–42*n* are formed in the wall of the nozzle 30 at various intervals along its length (three shown), which cause the particulate to bounce against the inner walls of the nozzle 30 and decelerate. In the embodiment where the conduit portion is 1.25 inches in diameter, crimps which extend ½" into the central lumen of the nozzle 30 defined by the conduit portion 45 have been found to be suitable.

The ratio of binder to rubber particulate can be regulated as desired by any suitable means, such as by increasing or decreasing the rate at which particulate is fed from the hopper 22 by increasing or decreasing the rotation speed of the feed manifold and spider. In addition, the rate of flow of the liquid binder can be regulated by any suitable means, such as by a ball or needle valve 44 located just before the proximal end of the nozzle 30. By properly setting these flow rates, the operator can spray a specified mixture of rubber and binder onto a substrate in a continuous fashion. Depending upon the curing characteristics of the binder being used, a surface can be applied by this method in one, two or more passes. Those skilled in the art will recognize that the ratio of binder to rubber desired depends upon the desired characteristics of the surface.

The regulation of each stream also allows other methods of application with the same machinery. For example, after the surface mat has been installed, it can be over-sprayed with binder alone (i.e., no rubber particulate) by simply turning off the particulate material feed mechanism. Similarly, a surface could be installed by spraying binder with no rubber and then blowing rubber with no (or a small proportion of) binder into the wet or uncured binder, allowing each course to cure, and then repeating the process until enough courses are applied to achieve the desired thickness.

The instant method and apparatus also is not limited to any specific size of rubber particulate. This is so because the rubber particulate passes through the central lumen of the dispersing ring 34, not through small orifices. Only the liquid binder flows through small orifices. In addition, the particular rheology of the liquid is not critical to the transport of the rubber particulate, since the binder and particulate are transported to the nozzle 30 separately. Suitable particulate material has average particulate diameters ranging from about 0.5 to about 7 mm. More specifically, particulate material having average diameters in the range of 0.5–1.5 mm, 1–3 mm, 1–4 mm, 1–5 mm, 3–6 mm and 4–7 mm have all been found to be functional.

Since the binder and rubber particulate are not combined until the separate streams reach the nozzle, premature curing is eliminated. Since the rubber particulate in the hopper is not mixed with the binder therein, it can be stored in the hopper 22 without problematic premature curing.

What is claimed is:

1. A method of applying a running track to a substrate, comprising:

introducing a first stream into a nozzle, said first stream comprising a rubber particulate material selected from the group consisting of terpolymer elastomer made from ethylene-propylene diene monomer, and styrene-butadiene rubber having an average particle size greater than 2 mm;

separately introducing a second stream into said nozzle, said second stream comprising a binder for said particulate material selected from the group consisting of an asphalt emulsion, a urethane and a latex;

causing said binder to encapsulate said rubber particulate material and form a first combined stream in said nozzle;

dispensing said first combined stream from said nozzle onto said substrate to form a first surface layer of said running track;

allowing said first surface layer to set;

introducing a third stream into a nozzle, said third stream comprising a rubber particulate material selected from the group consisting of terpolymer elastomer made from ethylene-propylene diene monomer, and styrene-butadiene rubber having an average particle size greater than 2 mm;

separately introducing a fourth stream into said nozzle, said fourth stream comprising a binder for said particulate material selected from the group consisting of an asphalt emulsion, a urethane and a latex;

causing said binder in said fourth stream to encapsulate said rubber particulate material in said third stream and form a second combined stream in said nozzle;

dispensing said second combined stream from said nozzle onto the set first surface layer to form a second surface layer of said running track.

2. The method of claim 1 wherein said first stream is introduced into said nozzle pneumatically.

3. The method of claim 1 wherein said nozzle comprises a dispersing ring, said dispersing ring comprising a central lumen and a plurality of circumferential orifices about said central lumen, and wherein said first stream is conveyed through said central lumen.

4. The method of claim 3 wherein said second stream is combined with said first stream by passing said second stream through said plurality of circumferential orifices in said dispersing ring, said plurality of circumferential orifices being in communication with said central lumen.

5. The method of claim 1 wherein said combined streams are dispensed from said nozzle by spraying.

6. The method of claim 1 wherein said first and second streams are introduced into said nozzle continuously.

7. The method of claim 1 wherein said first and third streams are comprised of the same particulate material, and wherein said second and fourth streams are comprised of the same binder.

8. The method of claim 1 wherein said second and fourth streams are a latex binder.

9. The method of claim 1 wherein said particulate material has an average particle diameter of from about 0.5 to about 7 mm.

10. The method of claim 1 wherein said particulate material has an average particle diamter of from about 0.5 to 1.5 mm.

11. A method of applying a running track to a substrate, comprising:

providing a nozzle having a proximal end, a distal end and a conduit portion therebetween;

transporting a first stream of rubber particulate material selected from the group consisting of terpolymer elastomer made from ethylene-propylene diene monomer, and styrene-butadiene rubber, said rubber particulate material having an average particle size greater than 2 mm, to said proximal end of said nozzle by way of a first air stream;

separately transporting a second stream of binder for said particulate material selected from the group consisting of an asphalt emulsion, a urethane and a latex to said proximal end of said nozzle;

introducing said second stream of binder into said first air stream;

conveying said resulting first air stream of binder and particulate material through said conduit portion while decelerating the flow rate of said air stream so as to cause said binder to encapsulate said rubber particulate material in said nozzle;

dispensing said first air stream from said distal end of said nozzle onto said substrate selected from the group consisting of asphalt and concrete to form a first surface layer of said running track;

allowing said first surface layer to set;

transporting a third stream of particulate material selected from the group consisting of terpolymer elastomer made from ethylene-propylene diene monomer, and styrene-butadiene rubber, said rubber particulate material having an average particle size greater than 2 mm, to said proximal end of said nozzle by way of a second air stream;

separately transporting a fourth stream of binder for said particulate material selected from the group consisting of an asphalt emulsion, a urethane and a latex to said proximal end of said nozzle;

introducing said fourth stream of binder into said second air stream;

conveying said resulting second air stream of binder and rubber particulate material through said conduit portion while decelerating the flow rate of said second air stream so as to cause said binder to encapsulate said rubber particulate material in said nozzle;

dispensing said second air stream from said distal end of said nozzle onto the set first surface layer to form a second surface layer of said running track.

12. The method of claim 11 wherein said air stream is decelerated in said conduit portion by providing a circuitous flow path therein.

13. The method of claim 11 wherein said air stream is dispensed from said distal end of said nozzle by spraying.

14. The method of claim 11 wherein said first and second streams are transported to said nozzle continuously.

15. The method of claim 11 wherein said first and third streams are comprised of the same particulate material, and wherein said second and fourth streams are comprised of the same binder.

16. The method of claim 11 wherein said second and fourth streams are a latex binder.

17. The method of claim 11 wherein said particulate material has an average particle diameter of from about 0.5 to about 7 mm.

* * * * *